US006389099B1

(12) United States Patent
Gueorguiev

(10) Patent No.: US 6,389,099 B1
(45) Date of Patent: May 14, 2002

(54) IRRADIATION SYSTEM AND METHOD USING X-RAY AND GAMMA-RAY REFLECTOR

(75) Inventor: Gueorgui Gueorguiev, Gainesville, FL (US)

(73) Assignee: Rad Source Technologies Inc., Boca Raton, FL (US)

( * ) Notice: Subject to any disclaimer, the term of this patent is extended or adjusted under 35 U.S.C. 154(b) by 0 days.

(21) Appl. No.: 09/709,896

(22) Filed: Nov. 13, 2000

(51) Int. Cl.[7] ..... G21K 5/00
(52) U.S. Cl. ..... 378/64; 378/84
(58) Field of Search ..... 378/64, 84, 145; 356/432–444

(56) References Cited

U.S. PATENT DOCUMENTS 4,958,363 A 9/1990 Nelson
5,216,539 A 6/1993 Bober et al.
5,310,603 A 5/1994 Fukuda et al.
5,400,382 A * 3/1995 Welt et al. ..... 378/69
5,433,988 A 7/1995 Fukuda et al.
5,712,894 A * 1/1998 Lanotte ..... 378/68
5,757,882 A * 5/1998 Gutman ..... 378/84
5,838,760 A * 11/1998 Moses ..... 378/119
6,285,030 B1 * 9/2001 Williams et al. ..... 250/454.11

* cited by examiner

*Primary Examiner*—Robert H. Kim
*Assistant Examiner*—Elizabeth Gemmell
(74) *Attorney, Agent, or Firm*—Leo J. Aubel

(57) ABSTRACT

A system and method for utilizing a radiation source for irradiating a product, the system including an radiation reflector comprised of a low Z, high density material. The reflector is positioned to receive radiation penetrating and exiting the product, and the reflector reflects the radiation back to the product to provide additional irradiation energy to the product.

12 Claims, 2 Drawing Sheets

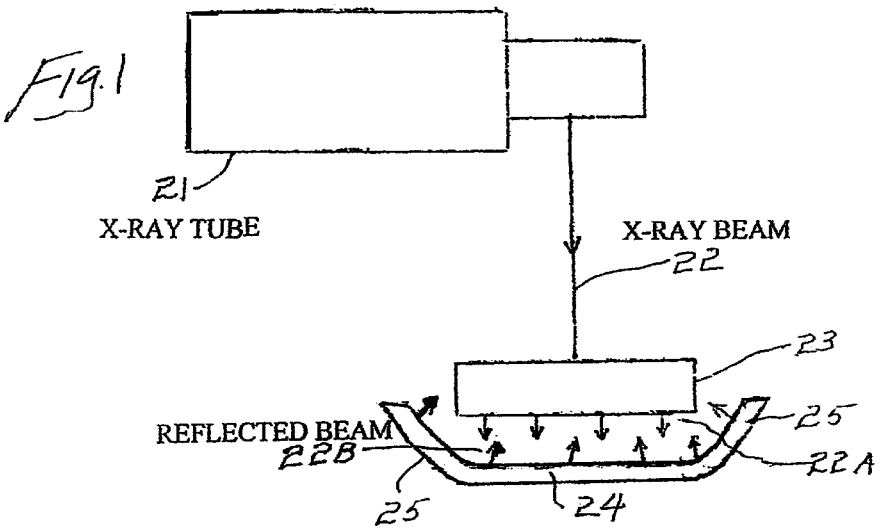
A Dose Distribution in a Water Phantom
Irradiated by a 160 KV X-ray Tube
| | WITHOUT REFLECTOR | 10cm BORON CARBIDE REFLECTOR |
|---|---|---|
| TOP SURFACE PHANTOM | 100% | 100% |
| MIDDLE OF PHANTOM | 76% | 90% |
| BOTTOM SURFACE OF PHANTOM | 49% | 70% |
Fig 2
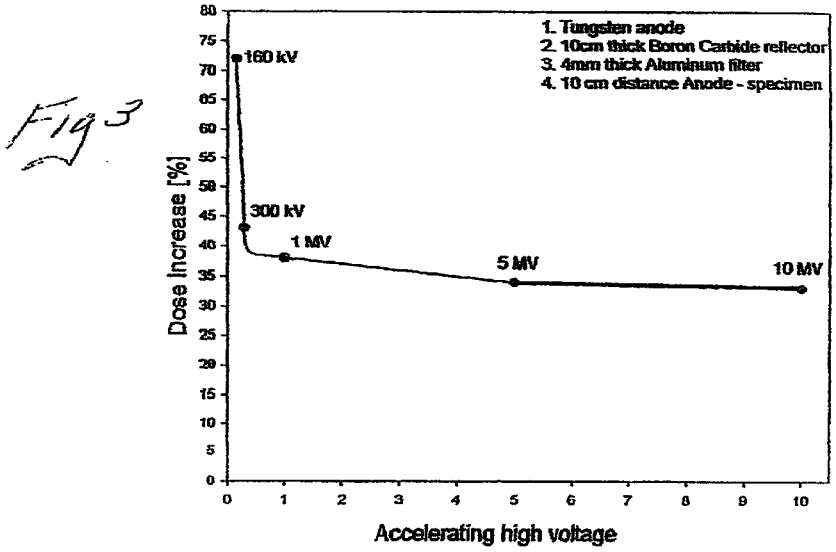

DOSE DISTRIBUTION IN A 4CM WATER SPECIMEN POSITIONED BETWEEN A 160 kV X-RAY TUBE AND A BORON CARBIDE REFLECTOR

| | | Distance 8" | Distance 9" | Distance 10" | Distance 11" | Distance 12" | Distance 14" | Distance 16" |
|---|---|---|---|---|---|---|---|---|
| Dose Ratio Top/Bottom 1cm water layers | 5cm Boron Carbide | 1.32 | 1.22 | 1.21 | 1.17 | 1.22 | 1.23 | 1.21 |
| | 10cm Boron Carbide | 1.30 | 1.21 | 1.21 | 1.17 | 1.18 | 1.22 | 1.20 |
| Dose Ratio Bottom/Top 1cm water layers | 5cm Boron Carbide | 0.76 | 0.82 | 0.83 | 0.85 | 0.82 | 0.81 | 0.82 |
| | 10cm Boron Carbide | 0.77 | 0.82 | 0.82 | 0.85 | 0.85 | 0.81 | 0.83 |

IRRADIATION SYSTEM AND METHOD USING X-RAY AND GAMMA-RAY REFLECTOR

BACKGROUND OF INVENTION

In efforts to improve the overall efficiency of present day irradiation systems, a number of attempts have been made to better utilize the energies developed in the systems. For example, in X-ray irradiation systems various schemes have been developed to obtain a higher percentage of usefulness of the rays produced by X-ray tube. That is, various systems have been developed in attempts to increase the percentage of the energy converted to X-rays that is actually utilized to irradiate a product or item. Further, various other systems and methods have been explored to provide a more even distribution of the X-rays throughout the surface area of the product being irradiated.

Also, in irradiation systems using gamma-quanta irradiation sources such as cobalt-60 and cesium 137, various efforts have been made to provide more even irradiation throughout the thickness of the product being irradiated. In prior art systems, the absorbed energy distribution effective on the product being irradiated depends on various factors including the material of the target, the distance of the source to the target and on the geometry of the irradiation procedure. The present invention provides a unique system and method for obtaining a means for improving the efficiency of the desired radiation.

The present invention improves the methodology and structure of irradiation systems by utilizing, the principal that in many irradiation procedures, the irradiation provided to the product penetrates that product and there is a significant amount of photons which penetrate and exit the product.

It is an object of the present invention to effectively reuse the photons which have passed through the irradiated product and exited the product. These exiting photons are reflected back to the product to re-irradiate the product to thereby provide more efficient irradiation.

It is another object of the invention to utilize radiation exiting the product, which has heretofore been wasted, to re-irradiate the product.

It is another object of the invention to provide a more even distribution of an absorbed dose throughout the surface area of the product being irradiated and throughout the thickness of the product.

It is a further object purpose of this invention to utilize unique irradiation techniques to provide an improved irradiation system and method.

SUMMARY OF THE INVENTION

The system and method of the invention utilize a source of X-ray or gamma ray irradiation which is directed to irradiate a product. The rays penetrate the product, and significant amounts of radiation (rays) exit the product on the opposite surface of the product. A radiation reflective low Z (atomic number), high density material is provided to reflect the rays penetrating the product. The reflected rays are directed and reflected back to the product to again irradiated the product thereby utilizing the reflected rays to provide a "secondary" irradiation source to effectively "re-irradiate" the product.

The foregoing features and advantages of the present invention will be apparent from the following more particular description of the invention. The accompanying drawings, listed herein below, are useful in explaining the invention.

DRAWINGS

FIG. 1 shows a preferred embodiment of the inventive system and method wherein a reflective, low Z high density material reflects the radiation (X-rays), which exit the product, back to the product to re-irradiate the product;

FIG. 2 is a table showing the percentage increase in the dosage provided by the invention when tested with a water equivalent phantom;

FIG. 3 is a graph showing the percentage increase in the dose provided by the inventive method and structure; and, FIG. 4 is a table, essentially an extension of the table of FIG. 2 showing the dose distribution in a standard water equivalent phantom positioned between a 160 kV tube and a boron carbide reflector.

DESCRIPTION OF THE INVENTION

Figures 1A, 4:
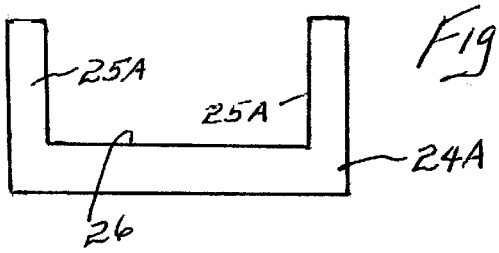
FIG. 1A is a cross section of a modification of the embodiment of FIG. 1 wherein the sides of the reflector are formed to be vertical (as oriented in FIG. 1)

The principal of the invention relates to all types of electromagnetic radiation, i.e., electronically produced X-ray and also gamma-quanta emitted after radioactive decay of naturally radioactive isotopes like Cesium-137, Cobalt-57, Cobalt-60 and all other X-ray emitters. The inventive system is constructed such that the irradiation interacts with the low Z material to obtain as much back scattered radiation as feasible, and with as little absorption of the radiation as practical. The reflector used in the inventive system may be any low Z, high density material; in the various embodiments of the invention, boron carbide, boron and carbon have been used since these three materials appear to be the best for the purpose of the invention. In the embodiment of the invention depicted in FIG. 1, relatively thick (bulk) material from one inch to several inches in thickness is used as the reflector in order to utilize the entire spectrum, i.e., all energies up to 160 keV. In the embodiment where mono-energy gamma-quanta from radioactive decay is used the thickness of the reflector can be precisely calculated to obtain maximum effectiveness.

In the embodiment of the inventive system and method as depicted in FIG. 1, an X-ray tube 21 of any suitable known type provides X-rays 22 to irradiate a product/object 23. As described above, the invention is applicable to the other type of irradiation as described above, the principal of the invention is to effectively reuse the photons produced by a source to re-irradiate the product to thereby provide more efficient irradiation system and process. That is, the invention is applicable to various sources of the electromagnetic radiation. The description of the embodiment of FIG. 1 is thus generally inclusive for the other sources mentioned.

Referring still to FIG. 1, X-rays 22 are directed to enter (penetrate) the upper surface (as oriented in the drawing) of the product. A portion of the radiation (rays), indicated at 22A, penetrates and exits the product at the opposite or lower surface of product 23. Also, as will be appreciated some of the X-rays also exit at the sides of the product. A radiation reflector 24, comprising a low Z (atomic number), high density material such as boron carbide, boron or carbon is positioned to reflect a major portion of the radiation 22B exiting the product 23 back to irradiate the product, effectively from the bottom upwardly.

Note that the term, "high density material" referred to herein, comprises boron, boron carbide, carbon or the like wherein the density is about 2 to 2.5 gr/cm$^3$. These materials have the highest density amongst the low Z chemical elements. A low Z material is chosen because of lower absorption of the irradiating rays. It is known from physics that the absorption of X-rays and gamma-quanta rises as Z to the 5th power and diminishes by energy as E to the 3.5 power where Z is the atomic number of the absorber and E is the energy of the photons. This means that the low energy photons like X-rays or gramma rays would be highly absorbed by high Z materials. The best absorbers are high Z chemical elements and the best scattering materials, i.e., material with low absorption capability are low Z chemical elements. It is an additional feature of the high density material used that it diminishes the depth of penetration into the reflector material layer thereby permitting the thickness of the reflecting layer to be decreased. The reflector 24 can comprise a planar surface, and/or the reflector 24 may be contoured to better direct the reflected X-rays back to the product, as depicted in FIG. 1. The reflector should be at least three quarters (¾) of an inch in thickness, and in the embodiment described with relation to FIGS. 1, the reflector is 10 cm in thickness (2.54 cms equals to 1 inch).

Reflectors of boron carbide, boron and carbon have been used in the inventive system. In one embodiment boron carbide used as the material for the reflector 24 since it is readily available in the marketplace. All three materials mentioned provide excellent results as a reflector of irradiation rays. Importantly, all three materials are quite stable and will not deteriorate with use. Stated in another way, all three materials can withstand the bombardment of the radiation without any substantial alteration in their photon-reflective characteristics.

A comparison was made of the outputs of reflectors made from each of the mentioned materials, i.e., and it has been found that the outputs from a pure boron reflector as well as from a carbon reflector follow essentially the output curves of boron carbide. The boron and carbon reflectors actually provide slightly higher peak outputs at the lower energy levels with carbon providing the highest peak outputs. However, as mentioned above boron carbide is used in the embodiment shown because it is generally available, durable and practical. Boron carbide has the highest density (2.52) amongst the three materials noted herein.

In the embodiment of FIG. 1, the reflector 24 has its sides or ends 25 angled upwardly, such that the reflected beam is directed to the bottom surface of the product 23, and also to the sides of the product to provide a more uniform irradiation to the entire product. It should be understood that the reflector 24 can be configured to accommodate products of different sizes and shapes. As depicted in FIG. 1A, if the product is circular, the reflector 24 can be configured to have a circular recess 26 and vertical sides 25A of selected thickness, to receive the product and more evenly reflect and re-irradiate its bottom, sides and even the top surface. In the case of electronically produced X-rays, the thickness of the reflector is chosen to effectively reflect the high energy in the broad X-ray spectrum. In the case of a gamma-ray source, it is easier to determine the proper thickness of the reflector, because the thickness can be adjusted (tuned) to only one energy.

FIGS. 2 and 3 show the results of tests conducted to quantify the improvement provided by the inventive method and apparatus. The test set-up was modeled to obtain results over a wide band of voltages, i.e., for commercially useful types of systems. It is, of course, known that water is a standard by which useful X-ray irradiation can be measured, particularly when considering irradiation of blood transfusion bags or containers, meat food products and vegetables.

The analysis to be described in connection with FIG. 2 and FIG. 3 was on a system such as shown in FIG. 1. Specifically, a four (4) cm thick water equivalent phantom 23 comprising water equivalent polystyrene layers was positioned to receive the radiation provided from the tungsten anode of the X-ray tube 21. The results shown in FIG. 2, were obtained when the product was positioned 10 inches from the output port of tube 21. The layers were located between the X-ray tube and the reflector 24 comprised a 10 cm thick flat boron carbide member. A standard aluminum or copper filter, not shown, filtered the X-rays from X-ray tube 21.

In FIG. 1, for purposes of depiction of the X-rays 22 penetrating the product 23 and the depiction of the reflected X-rays 22A, the space between the product 23 and reflector 24 has been exaggerated. Preferably, the upper surface of reflector 24 is placed in a position closely adjacent the bottom surface of the product. For example, when the product is mounted on a conveyor belt, the reflector is mounted immediately below the belt. The test results obtained in FIGS. 2–4, were obtained with the upper surface of the reflector 24 in position essentially abutting the bottom of the phantom product.

For the comparisons indicated in FIGS. 2 and 3, the system was first operated without the reflector 24 and readings taken of the data obtained. Next, the reflector 24 was mounted in the system and readings taken of this data. FIG. 2 is a table showing the dose distribution in the 4 cm thick water equivalent phantom product (standard layered phantom comprising suitable layers of plastic) irradiated by a 160 kV X-ray tube. It was found that the dose distribution decreases almost linearly from the top surface to the bottom surface of the phantom. Without a reflector 24 and assigning the value of 100% to the dosage at the top surface, it was found that the dosage at the middle (at the 2 cm thickness) of the phantom was 76% of the dosage at the top of the phantom, and the dosage at the bottom surface was 49%. With the boron carbide reflector 24 placed in position in accordance with the invention as indicated in FIG. 1, the dosage at the middle of the phantom was 90% percent of the dosage at the top surface, and the dosage at the bottom surface was 70% of the dosage at the top surface. That is, the dosage distribution was improved by about 14% at the middle of the phantom and 21% at the bottom of the phantom. The table of FIG. 2 shows the actual increase in the dosage (when using a 160 kV tube) as a result of providing the reflector 24.

The graph of FIG. 3 shows the results of calculations indicating the percentage increase as X-ray sources operating at higher kV's are used. As is known, X-ray tube sources are used in the 160–300 kV range; above 300 kV, electron accelerators are used as the source. In the graph of FIG. 3, the axis of abscissas indicates the kV (voltages) of respective X-ray sources having accelerating voltages varying from 160 kV to 10 MV. The axis of ordinates shows the dose increase in percentage. At a voltage of 160 kV, the percentage increase is about 72.5%; at 300 kV the percentage increase is about 42.5%; and at 1 MV the increase is about 37.5%. Note that the percentage of increase is calculated to remain essentially constant from 1 MV to 10 MV.

The table of FIG. 4 shows the dose distribution in a 4-cm water phantom positioned between a 160 kV X-ray tube and a boron carbide reflector. The table shows that, for the system depicted, the reflector compensates for distance variation between the tube and the product. Note that the dose ratio (dose at the top surface/dose at the bottom surface of the product) remains quite level for the distances from 8 inches to 16 inches. In the prior art systems, i.e., systems not using the inventive reflector system, the effective dosage varies as the reciprocal of the square of the distance between the product and the source. Thus a significant feature and an advantage of the inventive system and method are that it compensates for the influence of the increase in distance by between the source and the product by using a radiation reflector. As mentioned above, in prior art systems the effective dosage varies as the reciprocal of the square of the distance ($1/r^2$) i.e., low r—high dose, and high r—low dose where r is the distance between the source and the item or product being irradiated. This of course means that in prior art systems, when the product being irradiated is positioned close to the source, the surface of the product closest to the source receives quite different amounts of radiation than the surface of the product farthest from the source i.e., the uniformity of irradiation becomes worse as the distance between the source and the item is decreased. It can be readily appreciated that in prior art systems, the dose uniformity between the top and bottom surfaces of a product is better when the product is positioned at a greater distance than when it is positioned closely to the source, as can be readily determined mathematically. In such prior art systems there are several variables which may not vary linearly. For example as mentioned, the effective dosage varies as the square of the distance between the tube and the product, the thickness of the product affects the dosage. In contrast to the prior art, in the inventive system the product can be positioned closer to the source and get more radiation in the entire volume of the product without worsening the top/bottom ratio; this is due to the fact that the reflector provides a compensating factor in that the reflector helps the bottom surface obtain more absorbed dose. In the inventive system, the thickness of the reflector also affects the dosage but can also provide a compensating factor.

The specific data shown in the tables of FIGS. 2 and 4 may vary somewhat for different voltages, distances, and the thicknesses of the product and reflector. However, calculations indicate the compensating effect indicated in the table is generally applicable when a reflector in accordance with the invention is utilized. It should be understood that the inventive system applies to reflectors using any low Z, high density material although boron, boron carbide and carbon are the best materials to use for the inventive purposes.

An important advantage provided by the inventive system and method is that the product is more uniformly irradiated throughout the thickness of the product. Further, the inventive system provides a more even irradiation throughout the surface area of the product, i.e., the inventive system equalizes the doses absorbed by the central area of the product surface and the doses absorbed by the peripheral area of the surface which may be at different distances from the source (see FIG. 1).

Federal regulations require that the surface of the product that is farthest away from the ray source be irradiated within a certain range of the irradiation effective at the surface of the product closest to the ray source. The basis for this requirement is that the irradiation applied to various products must be effective to filly penetrate the thickness of the product, and must provide a uniform dose, within prescribed ranges, throughout the thickness of the product. In compliance with these regulations, the inventive system and method provide irradiation to the product from multiple sides by using a unique system and method comprising a single source of radiation and a radiation reflector which provides a more uniform dose to the product, i.e., it tends to equalize and balance the irradiation of the product from a single ray source throughout the surface area and thickness of the product. At present, certain prior art equipment includes two X-ray sources for irradiating a blood transfusion bag. By utilizing the present unique inventive scheme, the same equipment can use one X-ray source with a reflector, rather than two X-ray sources; the advantages are obvious.

While the invention has been particularly shown and described with reference to preferred embodiments thereof, it will be understood by those skilled in the art that various changes in form and details may be made therein without departing from the spirit and scope of the invention.

What is claimed is:

1. A system for irradiating a product with a source of radiation comprising, in combination, a) a source providing radiation to penetrate and irradiate the product; some of the radiation exiting the product; and b) a reflector of a high density, low Z material positioned to receive radiation exiting the product and to reflect back some portion of the radiation exiting the product to re-irradiate said product.

2. A system as in claim 1 wherein the product has a top surface, an opposite bottom surface, and side surfaces wherein a) the source of radiation is positioned to irradiate the top surface of the product and penetrate the product; some of said radiation exiting on said opposite bottom surface and the side surfaces of the product; and wherein b) said reflector is positioned to receive and reflect back radiation exiting said product to re-irradiate the product from said bottom and side surfaces.

3. A method of irradiating a selected product comprising, in combination, a) directing radiation of sufficient energy to cause some of said radiation to penetrate and exit the product;

b) positioning a reflector of a selected high density, low Z material at least three quarters inch thick to receive radiation exiting the product and to reflect said radiation; and c) directing the reflected radiation back to irradiate said product.

4. A system as in claim 1 wherein said reflector comprises boron carbide of at least three quarters inch in thickness.

5. A system as in claim 1 wherein said reflector comprises boron of at least three quarters inch in thickness.

6. A system as in claim 1 wherein said reflector comprises carbon of at least three quarters inch in thickness.

7. A system as in claim 1 wherein a) the product has a top surface, a bottom surface and side surfaces and the radiation enter the top surface;

b) said reflector comprises a low Z, high density material configured to reflect ray to the bottom surface of the product as well as to the sides of the product.

8. A system as in claim 1 wherein the reflector may be of boron, boron carbide or carbon of at least 10 cm in thickness to reflect X-rays or gamma rays.

9. A system as in claim 8 wherein the reflector is configured to reflect the radiation to selected areas of the product being irradiated.

10. A system for irradiating with X-rays a product which product has top, bottom and sides surfaces comprising, in combination, a) a source for providing X-rays directed to irradiate the top surface of the product;

b) said source of X-rays providing X-rays suitable for penetrating at least 4 cms of water equivalent product;

c) a reflector of a high density, low Z material positioned to receive X-rays exiting the product and to reflect back a major portion of the X-rays exiting the product to re-irradiate said product;

d) said reflector being of boron carbide and being of a thickness of at least 10 cms in thickness, e) said reflector being configured to reflect X-rays back to the sides of the product as well as to the bottom of the product; and f) said reflector being positioned adjacent the bottom surface and side surfaces.

11. A system as in claim 10 wherein said reflected X-rays are selectively directed to specific areas of the product.

12. A system as in claim 1 wherein said reflector is formed as recess for containing the product.

* * * * *